United States Patent [19]

Hudson

[11] 4,108,112

[45] Aug. 22, 1978

[54] DEVELOPER HOUSING

[75] Inventor: Frederick W. Hudson, West Henrietta, N.Y.

[73] Assignee: Xerox Corporation, Stamford, Conn.

[21] Appl. No.: 802,162

[22] Filed: May 31, 1977

[51] Int. Cl.[2] ..... G03G 15/08

[52] U.S. Cl. ..... 118/655; 118/653

[58] Field of Search ..... 118/647, 648, 649, 650, 118/653, 655, 636; 222/DIG. 1

[56] References Cited

U.S. PATENT DOCUMENTS

| | | | |
|---|---|---|---|
| 3,685,488 | 8/1972 | Stover | 118/647 |
| 3,717,122 | 2/1973 | Hudson | 118/655 |
| 3,809,012 | 5/1974 | Delvecchio | 118/653 |
| 3,991,712 | 11/1976 | Genthe et al. | 118/647 |
| 4,007,707 | 2/1977 | Buchan et al. | 118/647 |
| 4,041,903 | 8/1977 | Katakwa et al. | 118/658 |

OTHER PUBLICATIONS

Xerox Disclosure Journal, Lynch et al., "Xerographic Developer Flow Regulating Valve", vol. 1, No. 1 (Jan. 1976) pp. 59–60.

*Primary Examiner*—Mervin Stein
*Assistant Examiner*—Andrew M. Falik
*Attorney, Agent, or Firm*—James J. Ralabate; John E. Beck; George J. Cannon

[57] ABSTRACT

An improvement in development apparatus for developing a latent image with magnetic toner having a development zone defined at least in part by a sloping wall member along which magnetic toner migrates under the influence of gravity, residing in providing a flux channeling member affixed to the sloping wall member and within the development zone. Magnetic flux emanating from latent magnetic images passing through the development zone are channeled by the magnetic flux member and in cooperation with the magnetic toner forms a magnetic seal which prevents the flow of toner from the development zone. The present invention obviates the need to utilize a physical barrier which can cause damage to the surface of imaging members.

5 Claims, 4 Drawing Figures

DEVELOPER HOUSING

BACKGROUND OF THE INVENTION

This invention relates to magnetic imaging; and, more particularly, to tank development apparatus for applying magnetic toner to latent magnetic images.

Latent magnetic images on magnetizable imaging members are typically developed by deposition of magnetic developer material commonly referred to as magnetic toner onto the magnetizable imaging member. The developing material is attracted to the magnetizable member by magnetic fields constituting the latent magnetic image.

However, in developing latent magnetic images on a magnetizable member it is necessary to introduce the developing material within a very short distance from the latent magnetic image, typically within about 10 microns of the image, due to the short range nature of the magnetic forces associated with the latent magnetic image. Accordingly, flood contact development of latent magnetic images is generally preferred as a technique which will insure that the magnetic toner material is introduced within the short distance from a latent magnetic image to allow full, dense development.

PRIOR ART STATEMENT

Flood contact development for xerographic development is shown in U.S. Pat. Nos. 3,685,488 (FIGS. 1, 2 and 3), U.S. Pat. Nos. 3,380,437 (FIGS. 1–3), 3,393,663 (FIG. 2), 3,641,977 (FIGS. 1–4) and in 3,682,137 (FIGS. 1 and 2). Descriptive portions of the aforementioned patents corresponding to the figures describe the xerographic developer behavior and operation of the apparatus. In all except U.S. Pat. Nos. 3,641,977 and 3,682,137 the developer flows through the development apparatus. Flood contact development of latent magnetic images with magnetic toner is disclosed in U.S. Pat. No. 2,943,908 (FIG. 2). All of the aforementioned patents are deemed relevant only to the extent of showing flood, contact development of a latent image with toner material whereas U.S. Pat. Nos. 2,943,908; 3,641,977, and 3,682,137 indicate the desirability of simplifying development apparatus to a tank type system.

However, in most tank developer systems the developer is retarded from flowing through and exiting the development zone by a physical barrier which may be the brush bristles of the U.S. Pat. No. 2,943,908; the housing end of the U.S. Pat. No. 3,641,977 or the "J" shell design of the U.S. Pat. No. 3,682,137. The present invention increases the effectiveness of a physical barrier at the end or bottom of the development zone of a tank development system for use in developing latent magnetic images with magnetic toner.

SUMMARY OF THE INVENTION

It is an object of this invention to provide a novel development zone seal for tank development apparatus.

It is a further object to provide improved tank development apparatus for developing latent magnetic images with magnetic toner which apparatus utilizes the magnetic fields of the latent magnetic image to form, in combination with the magnetic toner, an effective seal of the development zone.

These and other objects and advantages are realized in accordance with the practice of the present invention by affixing a magnetic flux channeling member to the sloping wall member of the development zone. The flux channeling member is located within the development zone and comprises magnetically permeable material of low magnetic retentivity. Magnetic field emanating from latent magnetic images on a magnetizable imaging member are channeled through said magnetic flux channeling member, preventing magnetic toner in the vicinity of the channeled magnetic flux from passing out from the entrance of the developer zone when movement of the imaging member through the developer zone normally promotes such leakage. The invention provides an effective developer zone end seal.

BRIEF DESCRIPTION OF THE DRAWINGS

For a better understanding of the invention as well as other objects and further features thereof, reference is made to the following detailed disclousre of the preferred embodiments of the invention taken in conjunction with the accompanying drawings thereof, wherein.

DESCRIPTION OF THE PREFERRED EMBODIMENTS

Figure 1:
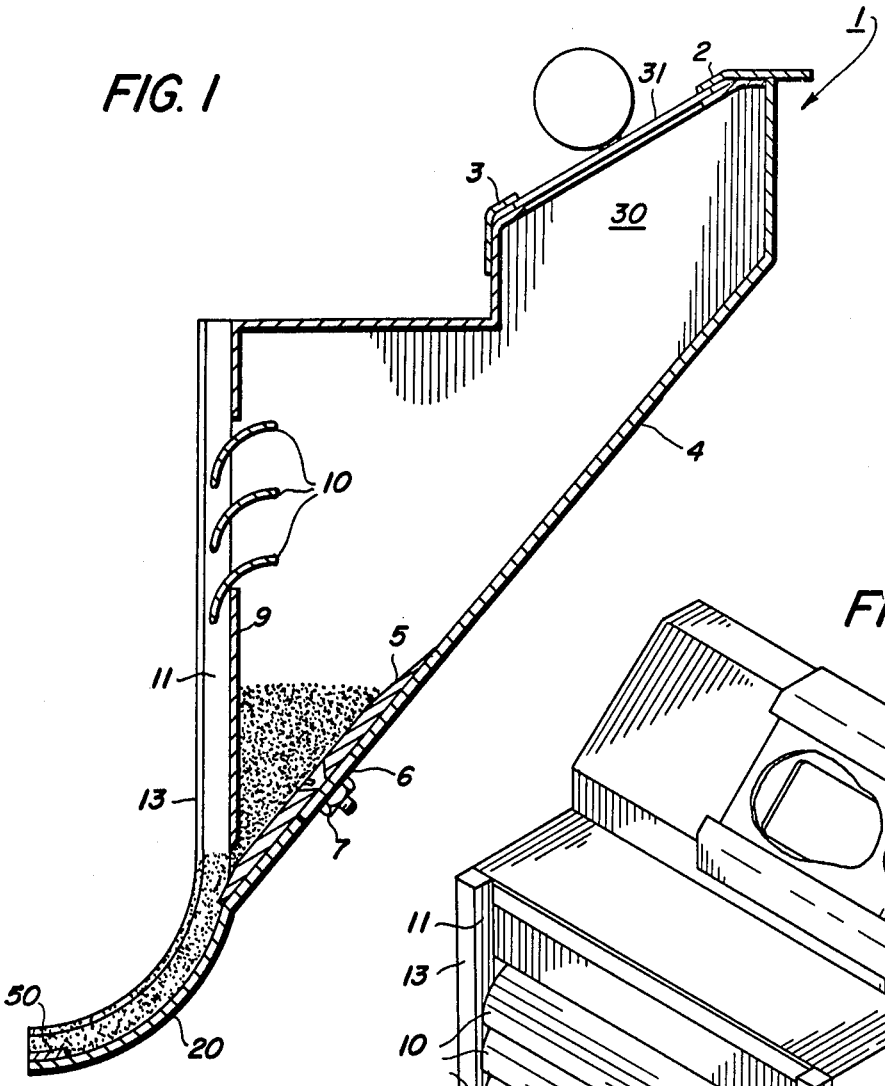
FIG. 1 is a schematic, cross-sectional side-view illustration of an embodiment of the present invention.

Referring now to FIG. 1, there is seen an embodiment of the present invention. The development apparatus which is improved by the present invention can be any tank type, sealed development zone apparatus present in the art. For purposes of illustration, the tank development apparatus in FIG. 1 comprises a housing 1 having an opening 30 in the uppermost wall covered by a sliding member 31 retained by flanges 2 and 3. Walls 9 and 4 of housing 1 define a toner storage or supply chamber communicating with a development zone A through an opening 8. Metering plate 5 is moveable into and out of opening 8 by movement of retention member 7 along slot 6 in wall 4. The developer housing is made of non-magnetic materials such as stainless steel to minimize interference with the latent magnetic image which is undergoing development and to minimize interference with the flowing properties of magnetic material deposited in the toner storage chamber.

Figure 2:
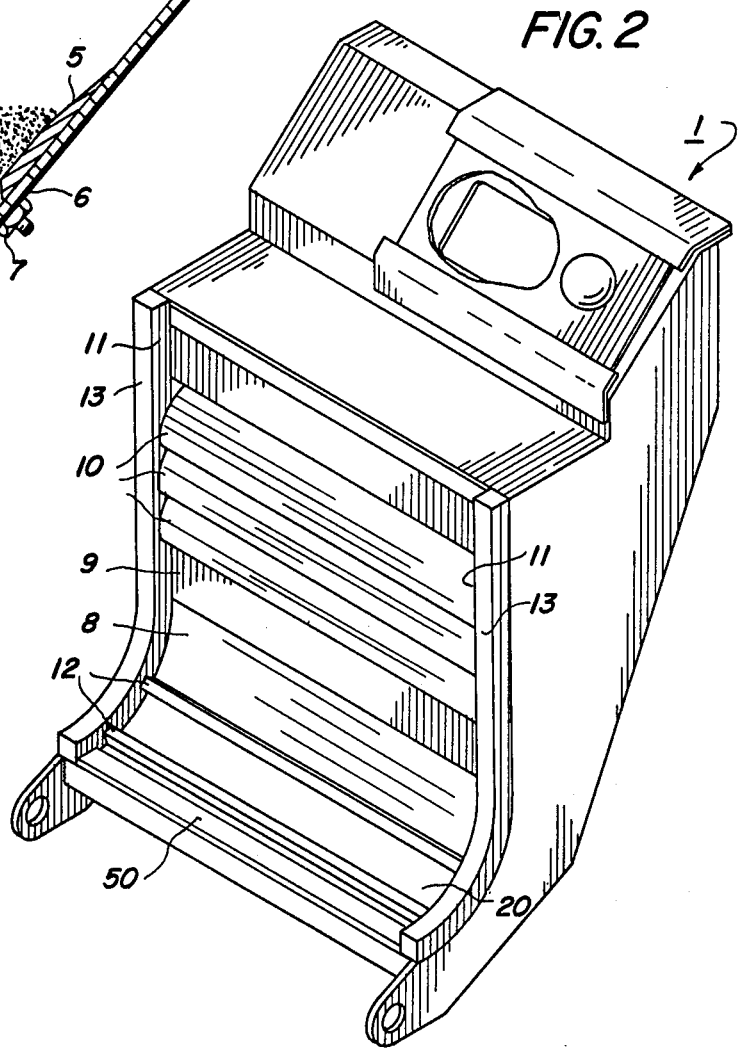
FIG. 2 is a schematic, perspective view of the embodiment of FIG. 1.

Sloping wall member 20 of housing 1 is shaped to conform to a predetermined path of travel of the magnetizable imaging member which is to be latently magnetically imaged and developed. Sloping wall member 20 may comprise a portion of either wall 9, or of wall 4, or may be a separate sloping wall member of the developer housing. Resilient seal forming means 11 may comprise any resilient material including deformable materials. Typical suitable materials includes, Teflon, a trademark of DuPont for tetrafluoroethylene fluorocarbon resins; soft rubber and polyvinyl chloride foam. Seal forming means 11 is affixed to the sides of walls 9 and 20 at least along the predetermined path of travel of the magnetizable imaging member which is to be developed, as illustrated in FIG. 2. Resilient seal forming means 11 is affixed to walls 20 and 9 on the sides thereof opposite the toner supply chamber as can best be seen from viewing FIG. 2. Resilient seal forming means 11 is affixed along the edges of walls 20 and 9 but not along the bottom of sloping wall member 20. Magnetic flux channeling member 50 is affixed along the bottom of wall 20. As depicted in FIG. 1 and 2, a low friction material is applied to the surface of deformable seal forming means 11 as surface 13. Low friction surface 13 comprises a material which has a coefficient of friction less than that of the material of resilient seal forming means 11. Teflon provides an entirely satisfactory low friction surface 13 which can be adhered to or bonded to means 11. Low friction surface 13 is utilized to minimize damage to the magnetizable imaging member by decreasing the sliding friction. Resilient means 11 and surface 13 can be fabricated into a single member such as a flexible Teflon member and molded plastics with low friction surfaces can be used.

Magnetic flux channeling member 50 is shown in FIG. 1. as being affixed upon the surface of sloping wall member 20 whereas, in FIG. 2, it is abutted to and coplanar with the surface of wall 20. Either is satisfactory. The only requirement is that member 50 be close enough to the latent magnetic image to be developed that the magnetic fields of the latent image are channeled into member 50. These fields are much weaker than the electrostatic fields involved in xerography and are typically oriented substantially parallel to the latent magnetic image bearing surface. Typical suitable spacings for member 50 above the imaging surface is up to about 0.030 inches. Member 50 can comprise any magnetically permeable material of low magnetic retentivity. Typical suitable materials include soft iron and Mμmetal. Member 50 can be increased in dimension along wall member 20 to present more impedance to air flow, thus cutting down turbulance in the developer zone.

Airborne toner is removed by baffles 10 above the development zone which are adapted to direct toner back into the toner supply chamber. While several baffle locations and designs can be employed in a perfectly satisfactory manner, FIG. 1 depicts baffles 10 extending through slots in wall 9. Airborne toner is diverted by baffles 10 from a region between the magnetizable imaging member, resilient seal forming means 11, and wall 9 through slots in wall 9 and back into the toner supply chamber. To minimize the formation of powder clouds of airborne toner, baffles 12 are mounted on wall 20 on the side of wall 20 facing the magnetizable imaging member. Baffles 12 may take any effective shape and it has been found that simple bars (shown in FIG. 2) having a height which precludes contact with the surface of the magnetizable imaging member when layer 13 is in engagement therewith will perform satisfactorily in reducing the formation of powder clouds of airborne toner.

As toner is poured through opening 30 into the toner supply chamber, it passes through opening 8 into the space defined by the magnetizable imaging member in contact with layer 13, resilient seal forming means 11 and the top of opening 8. Metering plate 5 can be adjusted so that the magnetic toner replenishment rate from the magnetic toner supply chamber into the development zone just equals the depletion of magnetic toner from the development zone. The height of the developer zone is automatically maintained by toner in the supply chamber.

Figure 3:
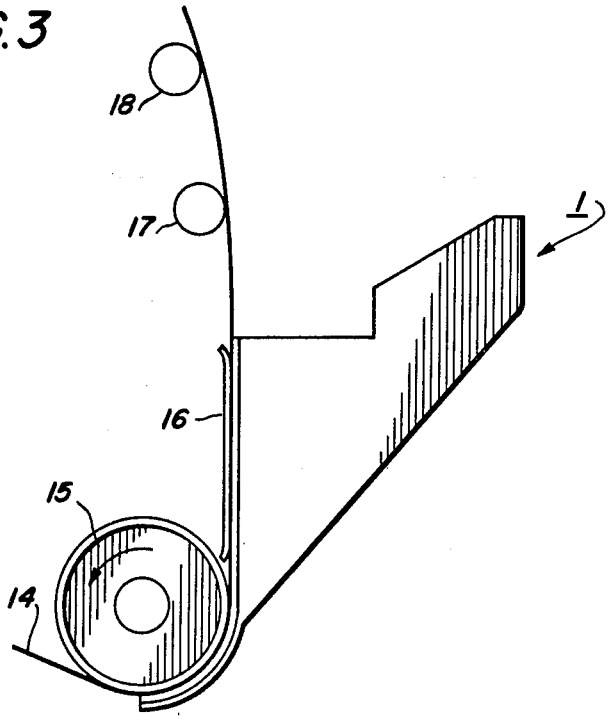
FIG. 3 is a schematic illustration of the embodiment depicted in FIG. 1 employed with a magnetic imaging tape.

FIg. 3 schematically illustrates the employment of the embodiment of FIGS. 1 and 2 to develop a latent magnetic image residing on a magnetic web or magnetic tape 14. The predetermined portion of the path of travel taken by magnetic tape 14 selected for the developer station (i.e., that portion of the path of travel of tape 14 along which the developer zone A is to be located) is an arcuate path about roller 15. The path of travel of tape 14 as depicted in FIG. 3, comes into the developer zone from the left, is routed about roller 15, against a backing member 16, and diverted onto other process stations by idler rollers 17 and 18. Tape 14 can be utilized in the form of an endless loop or can be utilized in association with supply and takeup reels. The significant point to be noted in FIG. 3 is that the wall portion of the developer housing which extends below the toner supply chamber and enters into defining the developer zone is made very small and performs in an entirely satisfactory manner. Yet, the amount of toner present in the toner supply toner of the tank development system of the present invention is many times greater than that contained in the development zone, allowing automatic replenishment of toner in the development zone and the development of numerous latent magnetic images.

Figure 4:
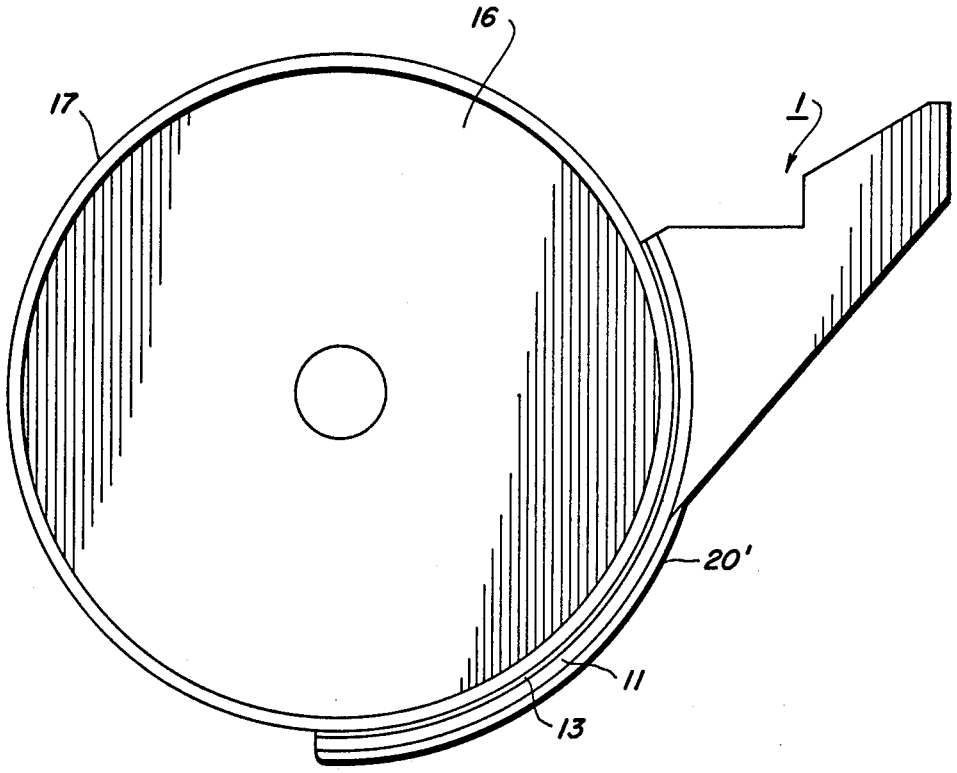
FIG. 4 is a schematic illustration of the present invention used with an imaging member mounted around a drum.

FIG. 4 schematically illustrates the utilization of the present invention in connection with magnetically developing a latent magnetic image which resides on a magnetizable imaging member formed along or wrapped around a drum surface. Magnetizable imaging member 17 is formed along or wrapped around the surface of drum 16 in FIG. 4. Developer housing 1 is essentially the same as that depicted in FIGS. 1–3 and 5 but shows a longer wall portion 20' as an illustration of permissible variations in accordance with the spirit of the present invention.

Other modifications and variations will become apparent to those skilled in the art upon a reading of the present disclosure. These are intended to be within the scope of the present invention.

What is claimed is:

1. In magnetic development apparatus of the type having a development zone defined at least in part by a sloping wall member along which magnetic toner migrates under the influence of gravity, the improvement comprising: a magnetic flux channeling member comprising magnetically permeable material of low magnetic retentivity; and baffle means affixed to said sloping wall member upon the side thereof contacted by toner during development.

2. The apparatus of claim 1 wherein said flux channeling member is affixed at the bottom of said sloping wall member and is coplanar with the side of said wall member contacted by toner during development.

3. The apparatus of claim 1 wherein said flux channeling member is affixed at the bottom of said sloping wall member and upon the side of said wall member contacted by toner during development.

4. The apparatus of claim 1 wherein said flux channeling member comprises soft iron.

5. The apparatus of claim 1 wherein said flux channeling member comprises Mμmetal.

* * * * *